US008012659B2

(12) United States Patent
Shu et al.

(10) Patent No.: US 8,012,659 B2
(45) Date of Patent: Sep. 6, 2011

(54) IMAGE FORMING APPARATUS, TONER, AND PROCESS CARTRIDGE

(75) Inventors: Hyo Shu, Mishima (JP); Minoru Masuda, Numazu (JP); Yasuaki Iwamoto, Numazu (JP); Yasutada Shitara, Numazu (JP)

(73) Assignee: Ricoh Company Limited, Tokyo (JP)

( * ) Notice: Subject to any disclaimer, the term of this patent is extended or adjusted under 35 U.S.C. 154(b) by 897 days.

(21) Appl. No.: 11/956,378

(22) Filed: Dec. 14, 2007

(65) Prior Publication Data

US 2009/0155706 A1 Jun. 18, 2009

(51) Int. Cl.
*G03G 9/08* (2006.01)

(52) U.S. Cl. ..... 430/109.4; 430/108.2; 399/252; 399/330

(58) Field of Classification Search ..... 430/109.4, 430/108.2; 399/252, 330
See application file for complete search history.

(56) References Cited

U.S. PATENT DOCUMENTS

| | | | |
|---|---|---|---|
| 4,841,331 | A | 6/1989 | Nakayam et al. |
| 4,945,022 | A | 7/1990 | Nakayam et al. |
| 4,980,258 | A | 12/1990 | Aoki et al. |
| 5,225,303 | A | 7/1993 | Tomita et al. |
| 5,514,511 | A | 5/1996 | Iwamoto et al. |
| 5,721,083 | A | 2/1998 | Masuda et al. |
| 5,840,456 | A | 11/1998 | Tomita et al. |
| 6,183,926 | B1 | 2/2001 | Kuroda et al. |
| 6,258,502 | B1 | 7/2001 | Nakamura et al. |
| 6,303,257 | B1 | 10/2001 | Hasegawa et al. |
| 6,363,229 | B1 | 3/2002 | Shiraishi et al. |
| 6,368,765 | B2 | 4/2002 | Izu et al. |
| 6,406,826 | B1 | 6/2002 | Suzuki et al. |
| 6,468,706 | B2 | 10/2002 | Matsuda et al. |
| 6,503,681 | B2 | 1/2003 | Makino et al. |
| 6,544,704 | B1 | 4/2003 | Matsuda et al. |
| 6,593,048 | B2 | 7/2003 | Sasaki et al. |
| 6,667,141 | B2 | 12/2003 | Iwamoto et al. |
| 6,699,632 | B2 | 3/2004 | Higuchi et al. |
| 6,770,411 | B2 | 8/2004 | Masuda et al. |
| 6,790,575 | B2 | 9/2004 | Sasaki et al. |

(Continued)

FOREIGN PATENT DOCUMENTS

JP 41-20153 11/1966

(Continued)

OTHER PUBLICATIONS

U.S. Appl. No. 11/755,484, filed May 30, 2007, Watanabe, et al.

(Continued)

*Primary Examiner* — Mark A Chapman
(74) *Attorney, Agent, or Firm* — Oblon, Spivak, McClelland, Maier & Neustadt, L.L.P.

(57) ABSTRACT

An image forming apparatus including a fixing device to fix a toner image on a recording medium including a heat roller and an oil applicator to apply a silicone oil to the heat roller, having a system speed of from 500 to 1700 mm/sec, and using a toner including a binder resin including a crystalline polyester resin and an amorphous polyester resin; a fatty acid amide compound; and a colorant, wherein a ratio (W/R) of a height (W) of a peak at a wavenumber of 1638 $cm^{-1}$, specific to the fatty acid amide compound, to a height (R) of a peak at a wavenumber of 829 $cm^{-1}$, specific to the amorphous polyester resin, is from 0.010 to 0.040 in an absorption spectrum obtained by an ATR method (total reflectance method) using a Fourier transform infrared (FT-IR) spectrophotometer.

18 Claims, 5 Drawing Sheets

U.S. PATENT DOCUMENTS

| | | | | |
|---|---|---|---|---|
| 6,811,944 | B2 | 11/2004 | Higuchi et al. | |
| 6,813,461 | B2 | 11/2004 | Higuchi et al. | |
| 6,818,369 | B2 | 11/2004 | Sugiura et al. | |
| 6,828,075 | B2 | 12/2004 | Suzuki et al. | |
| 6,835,517 | B2 | 12/2004 | Kondo et al. | |
| 6,856,781 | B2 | 2/2005 | Matsuda et al. | |
| 6,861,191 | B2 | 3/2005 | Mochizuki et al. | |
| 6,898,406 | B2 | 5/2005 | Suzuki et al. | |
| 6,911,289 | B2 | 6/2005 | Higuchi et al. | |
| 6,924,073 | B2 | 8/2005 | Higuchi et al. | |
| 6,934,484 | B2 | 8/2005 | Suzuki et al. | |
| 6,946,229 | B2 | 9/2005 | Suzuki et al. | |
| 7,024,140 | B2 | 4/2006 | Masuda et al. | |
| 7,029,816 | B2 | 4/2006 | Sasaki et al. | |
| 7,125,638 | B2 | 10/2006 | Suzuki et al. | |
| 7,162,187 | B2 | 1/2007 | Koichi et al. | |
| 7,163,773 | B2 | 1/2007 | Sugiura et al. | |
| 7,163,774 | B2 | 1/2007 | Shiraishi et al. | |
| 7,166,403 | B2 | 1/2007 | Ichikawa et al. | |
| 7,169,522 | B2 | 1/2007 | Sugiura et al. | |
| 7,169,525 | B2 | 1/2007 | Sugiura et al. | |
| 7,172,844 | B2 | 2/2007 | Umemura et al. | |
| 7,177,555 | B2 | 2/2007 | Shu et al. | |
| 7,183,029 | B2 | 2/2007 | Masuda et al. | |
| 7,217,485 | B2 | 5/2007 | Hasegawa et al. | |
| 7,258,959 | B2 | 8/2007 | Nakayama et al. | |
| 7,261,989 | B2 | 8/2007 | Sugiura et al. | |
| 7,273,688 | B2 | 9/2007 | Suzuki et al. | |
| 7,288,353 | B2 | 10/2007 | Sugiura et al. | |
| 7,648,812 | B2 * | 1/2010 | Umehara | 430/108.21 |
| 2002/0039698 | A1 | 4/2002 | Sasaki et al. | |
| 2003/0152857 | A1 | 8/2003 | Sugiura et al. | |
| 2003/0190543 | A1 | 10/2003 | Sugiura et al. | |
| 2004/0058260 | A1 | 3/2004 | Katoh et al. | |
| 2005/0026064 | A1 | 2/2005 | Sugiura et al. | |
| 2005/0030595 | A1 | 2/2005 | Koichi et al. | |
| 2005/0089786 | A1 | 4/2005 | Sugiura et al. | |
| 2005/0089787 | A1 | 4/2005 | Uchinokura et al. | |
| 2005/0208403 | A1 | 9/2005 | Shu et al. | |
| 2005/0208408 | A1 | 9/2005 | Uchinokura et al. | |
| 2006/0051692 | A1 | 3/2006 | Hasegawa et al. | |
| 2006/0063092 | A1 | 3/2006 | Hasegawa et al. | |
| 2006/0068306 | A1 | 3/2006 | Shu et al. | |
| 2006/0093943 | A1 | 5/2006 | Shu et al. | |
| 2006/0165989 | A1 | 7/2006 | Takikawa et al. | |
| 2006/0166123 | A1 | 7/2006 | Masuda | |
| 2006/0204883 | A1 | 9/2006 | Nakayama et al. | |
| 2006/0240350 | A1 | 10/2006 | Shu et al. | |
| 2007/0031748 | A1 | 2/2007 | Kotsugai et al. | |
| 2007/0141498 | A1 | 6/2007 | Umehara | |
| 2007/0184377 | A1 | 8/2007 | Shu et al. | |
| 2007/0248380 | A1 | 10/2007 | Iwamoto et al. | |
| 2007/0275315 | A1 | 11/2007 | Nagatomo et al. | |

FOREIGN PATENT DOCUMENTS

| | | |
|---|---|---|
| JP | 42-1627 | 1/1967 |
| JP | 43-27596 | 11/1968 |
| JP | 44-6397 | 3/1969 |
| JP | 45-26478 | 9/1970 |
| JP | 53-127726 | 11/1978 |
| JP | 57-167033 | 10/1982 |
| JP | 60-090344 | 5/1985 |
| JP | 62-063940 | 3/1987 |
| JP | 64-015755 | 1/1989 |
| JP | 02-082267 | 3/1990 |
| JP | 03-041470 | 2/1991 |
| JP | 03-229264 | 10/1991 |
| JP | 11-249339 | 9/1999 |
| JP | 11-305486 | 11/1999 |
| JP | 2001-222138 | 8/2001 |
| JP | 2002-214833 | 7/2002 |
| JP | 2002-278135 | 9/2002 |
| JP | 2005-189594 | 7/2005 |
| JP | 2006-113473 | 4/2006 |

OTHER PUBLICATIONS

U.S. Appl. No. 11/755,517, filed May 30, 2007, Iwamoto, et al.

U.S. Appl. No. 12/210,536, filed Sep. 15, 2008, Shu, et al.

* cited by examiner

IMAGE FORMING APPARATUS, TONER, AND PROCESS CARTRIDGE

BACKGROUND OF THE INVENTION

1. Field of the Invention

The present invention relates to an image forming apparatus for use in electrophotography. In addition, the present invention also relates to a toner and a process cartridge used for the image forming apparatus.

2. Discussion of the Background

In the field of electrophotography, demands for high-speed printing and high-quality images have increased recently. In particular, the fixability of a toner, which is one of the important factors having an influence on the resultant image quality, deteriorates as the image forming speed (i.e., the system speed of an image forming apparatus) increases. Therefore, it is difficult to realize both good fixability and high-speed printing at the same time.

An unfixed toner image is firmly fixed on a paper by application of heat and pressure in a fixing device. When the system speed increases, the unfixed toner image on the paper may not receive a satisfactory amount of heat. As a result, the toner image may be weakly fixed and tends to peel off from the paper.

In order not to deteriorate fixability even if the system speed increases, the fixing temperature may be increased. However, when the fixing temperature increases, the following problems may arise:

(1) the inner temperature of an image forming apparatus increases and side effects are caused;

(2) the life of a fixing member deteriorates; and (3) the energy conservation is not achieved.

For the above reasons, the toner itself is required to improve fixability especially for use in an ultrahigh-speed machine. A toner having good fixability even when the image forming speed is high and a low amount of heat is applied is required.

Various attempts have been made to improve fixability of a toner.

For example, a technique of controlling thermal properties of a binder resin is proposed. When the glass transition temperature (Tg) of a binder resin decreases, thermostable preservability and fixing strength of the resultant toner may deteriorate. When the molecular weight of a binder resin decreases, the softening temperature ($T(F_{1/2})$) (to be explained in detail later) of the resultant toner decreases. As a result, a hot offset problem, in that part of a fused toner image is adhered and transferred to the surface of a heat member and then the part of the toner image is re-transferred to an undesired portion of a sheet itself or the following sheet of a recording material, is caused and the resultant image has excessively high glossiness. A toner having a good combination of low-temperature fixability, thermostable preservability, and hot offset resistance is not yet obtained only by controlling thermal properties of the binder resin.

In attempting to improve low-temperature fixability of a toner, unexamined published Japanese Patent Applications Nos. (hereinafter referred to as JP-A) 60-90344, 64-15755, 02-82267, 03-229264, 03-41470, and 11-305486 have disclosed toners including a polyester resin potentially having relatively good low-temperature fixability and thermostable preservability, instead of including a styrene-acrylic resin which has been conventionally used.

JP-A 62-63940 discloses a toner including a binder resin including a specific non-polyolefin crystalline polymer capable of sharply melting at the glass transition temperature thereof. However, the molecular structure and the molecular weight of the polymer are not optimized therein.

Japanese Patent No. 2931899 and JP-A 2001-222138 have disclosed techniques in which a binder resin and a toner, respectively, include a crystalline polyester resin capable of sharply melting. However, these techniques are not satisfactory to obtain a toner simultaneously having low-temperature fixability and preservability.

JP-A2002-214833 discloses a toner including a crystalline polyester resin and an amorphous polyester resin, which are incompatible with each other and form a phase separation structure (i.e., a sea-island structure) in the toner. The toner has a specific DSC curve properties. However, this technique is also not satisfactory to obtain a toner simultaneously having low-temperature fixability and preservability.

As mentioned above, the use of a crystalline polyester resin as a binder resin is effective for improving low-temperature fixability of the resultant toner, especially for use in a high-speed or ultrahigh-speed image forming apparatus. However, the crystalline polyester resin tends to cause side effects such as a filming problem in that a toner forms a film thereof on a photoreceptor etc. when an image is formed. If the filming problem seriously occurs, abnormal images such as a solid image having image defects (white spots) tend to be produced. Therefore, a toner satisfying both low-temperature fixability and filming resistance is required so as to be used in an ultrahigh-speed image forming apparatus having a system speed of from 500 to 1700 mm/sec.

JP-A2005-189594 discloses a cleaning device in which toner particles remaining on a photoreceptor are collected by a brush roller. A bias having the same polarity to the toner particles are applied to the brush roller so that the collected toner particles are ejected onto the photoreceptor. When the ejected toner particles pass a cleaning blade, films of the toner formed on the photoreceptor are scraped off. Although the films may be scraped off by the above technique, the fundamental problem of the occurrence of the filming problem cannot be solved.

JP-A2002-278135 discloses a toner including wax particles having a specific circularity. However, this technique is also not satisfactory to obtain a toner simultaneously having good low-temperature fixability and filming resistance. In particular, there is a problem such that the minimum fixable temperature, at which a fixed image has resistance to an abrasion, increases with time.

SUMMARY OF THE INVENTION

Accordingly, an object of the present invention is to provide an ultrahigh-speed image forming apparatus capable of producing high quality images.

Another object of the present invention is to provide a toner capable of producing high quality images when used in the ultra-high speed image forming apparatus without causing the filming problem while having good low-temperature fixability.

Yet another object of the present invention is to provide a process cartridge capable of producing high quality images.

These and other objects of the present invention, either individually or in combinations thereof, as hereinafter will become more readily apparent can be attained by an image forming apparatus, comprising:

an image bearing member configured to bear a latent image;

a charging device configured to charge a surface of the image bearing member;

an irradiating device configured to write an electrostatic latent image on the charged surface of the image bearing member;

a developing device configured to develop the electrostatic latent image formed on the surface of the image bearing member with a developer comprising a toner;

a transfer device configured to transfer the toner image onto at least one of a transfer member and a recording medium;

a cleaning device configured to remove residual toner particles remaining on the surface of the image bearing member; and a fixing device configured to fix the toner image on the recording medium, comprising:

a heat roller; and an oil applicator configured to apply a silicone oil to the heat roller, wherein the image forming apparatus has a system speed of from 500 to 1700 mm/sec, and wherein the developing device comprises a developer comprising a toner comprising mother toner particles comprising:

a binder resin comprising a crystalline polyester resin and an amorphous polyester resin;

a fatty acid amide compound; and a colorant, wherein a ratio (W/R) of a height (W) of a peak at a wavenumber of 1638 $cm^{-1}$, specific to the fatty acid amide compound, to a height (R) of a peak at a wavenumber of 829 $cm^{-1}$, specific to the amorphous polyester resin, is from 0.010 to 0.040 in an absorption spectrum obtained by an ATR method (total reflectance method) using a Fourier transform infrared (FT-IR) spectrophotometer;

and a toner and a process cartridge used for the image forming apparatus.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

Figure 1:
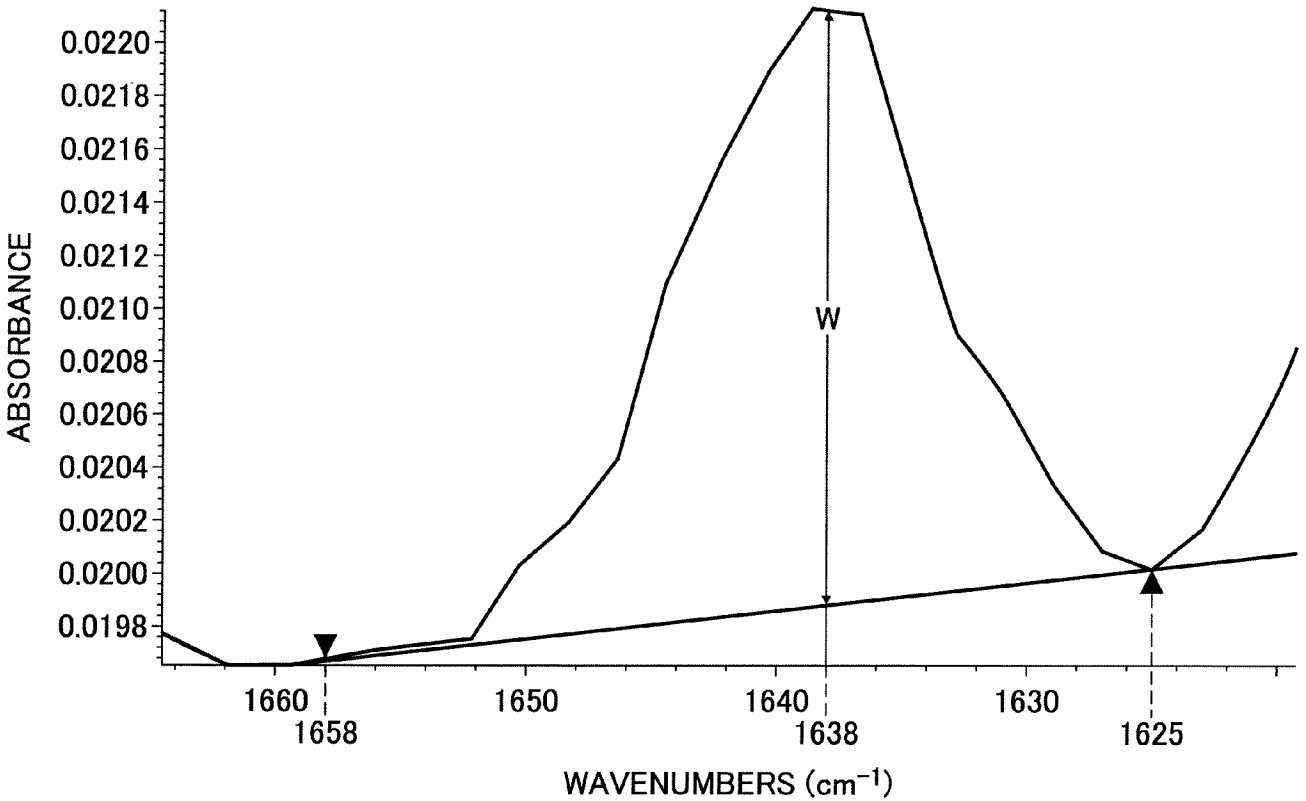
FIGS. 1 and 2 are examples of absorption spectrums of a fatty acid amide compound and an amorphous polyester resin, respectively, obtained by an ATR method (total reflectance method) using a Fourier transform infrared (FT-IR) spectrophotometer.

Generally, the present invention provides an ultrahigh-speed image forming apparatus using a toner including a crystalline polyester resin and a fatty acid amide compound, which may not cause the filming problem and have good fixability.

The use of a toner including a crystalline polyester resin is effective for improving fixability in an ultrahigh-speed image forming apparatus having a system speed of from 500 to 1700 mm/s. In the present invention, the system speed is defined as a movement speed of a fixing medium.

However, the toner including a crystalline polyester resin has poor preservability. This is because a part of the crystalline polyester resin remains in compatible with an amorphous resin on the process of recrystallization from an amorphous state to a crystalline state. The crystalline polyester resin in a crystalline state has a melting point of about 110° C. On the other hand, when the crystalline polyester resin is in a state being in compatible with an amorphous resin, an endothermic peak is observed at a temperature of about 55° C. in a DSC curve, resulting in deterioration of preservability of the resultant toner. In order not to deteriorate preservability of the toner, a fatty acid amide compound is included in the toner so as to accelerate the recrystallization of the crystalline polyester resin.

Further, the present inventors found that the use of the fatty acid amide compound prevent the time-varying increase (i.e., deterioration) of the minimum fixable temperature at which a fixed image has a resistance to an abrasion, when the image is fixed in the image forming apparatus of the present invention. This phenomenon arises from the compatibility of a silicone oil, slightly applied to a heat roller, with the fatty acid amide compound. The silicone oil is applied to a heat roller of a fixing device in the present invention. Therefore, the silicone oil remains on the surface of the fixed toner image. Since the silicone oil repels the fatty acid amide compound, the silicon oil hardly penetrates into a toner image including a toner including the fatty acid amide compound for a long period of time. Therefore, the silicone oil tends to remain on the surface of the toner image for a long period of time. As a result, the toner image has a resistance to an external abrasion, resulting in decreasing (i.e., improving) the minimum fixable temperature mentioned above. In particular, the fatty acid amide compound localized near the surface of the toner is effective.

In contrast, although the silicone oil remains on the surface of a toner image including a toner including no fatty acid amide compound immediately after the image is fixed and the toner image temporarily has a resistance to an abrasion, the silicone oil penetrates into the toner image with time and the minimum fixable temperature mentioned above may increase (i.e., deteriorates).

The localization condition of the fatty acid amide compound near the surface of a toner particle may be determined from an absorption spectrum obtained by an ATR method (total reflectance method) using a Fourier transform infrared (FT-IR) spectrophotometer such as AVATAR 370 (from Thermo Fisher Scientific, Inc.). The ratio (W/R) of a height (W) of a peak specific to the fatty acid amide compound to a height (R) of a peak specific to the amorphous resin, observed in the absorption spectrum, represents the localization condition of the fatty acid amide compound near the surface of a toner particle. The ratio (W/R) is preferably from 0.010 to 0.040, and more preferably from 0.015 to 0.035.

When the ratio (W/R) is too small, the resultant toner has good filming resistance, but poor fixability and preservability.

When the ratio (W/R) is too large, the resultant toner has good fixability and preservability, but poor filming resistance.

In the present invention, the ratio (W/R) is controlled using a method of quality engineering. In particular, the composition of raw materials of a toner and the conditions in manufacturing processes such as a kneading process, a pulverization process, and an external-additive-mixing process, etc., are optimized so that the ratio (W/R) is in a range of from 0.010 to 0.040. In other words, the optimum raw material compositions and manufacturing conditions for manufacturing a toner having a good balance of filming resistance, fixability, preservability, and manufacturability may be proposed.

For example, when the amount of the fatty acid amide compound is too large in the raw material composition, too large an amount of the fatty acid amide compound may be localized near the surface of a toner particle. When the raw material composition includes a large amount of a resin having a small molecular weight, the fatty acid amide compound tends to expose at the surface of a toner particle. The amount of the fatty acid amide localized near the surface of a toner particle may be also controlled by the composition of the external additives and the mixing conditions.

A method for measuring the ratio (W/R) will be explained in detail.

The ratio (W/R) may be determined from an absorption spectrum obtained by an ATR method (total reflectance method) using a Fourier transform infrared (FT-IR) spectrophotometer. A measurement sample subjected to the ATR method needs to have a smooth surface. Therefore, a toner may be pelletized to have a smooth surface. In particular, 0.6 g of a toner is pelletized into a pellet having a diameter of 20 mm by imposing a load of 1 t for 30 seconds using a pelletizer.

Figure 2:
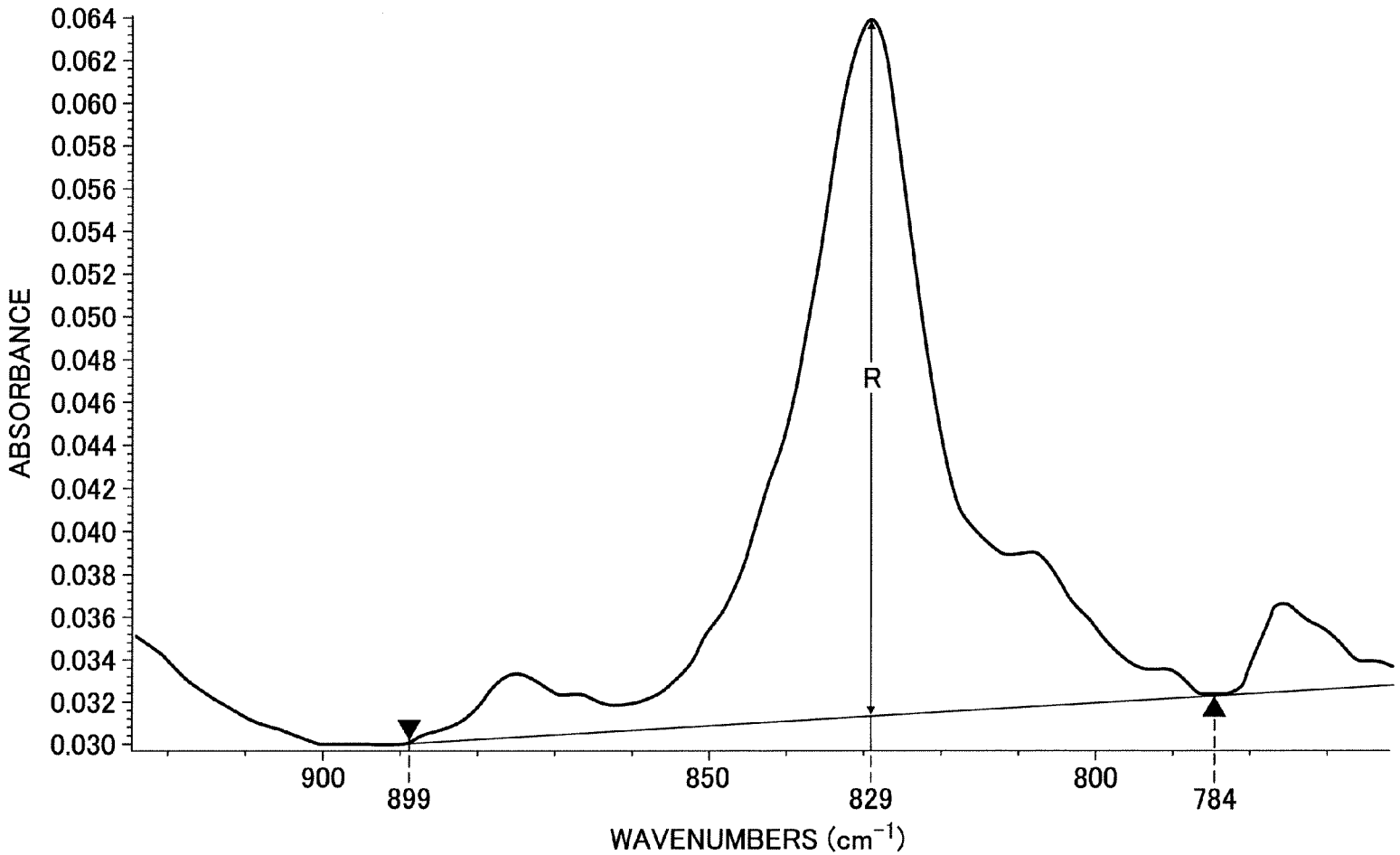
Figure 3:
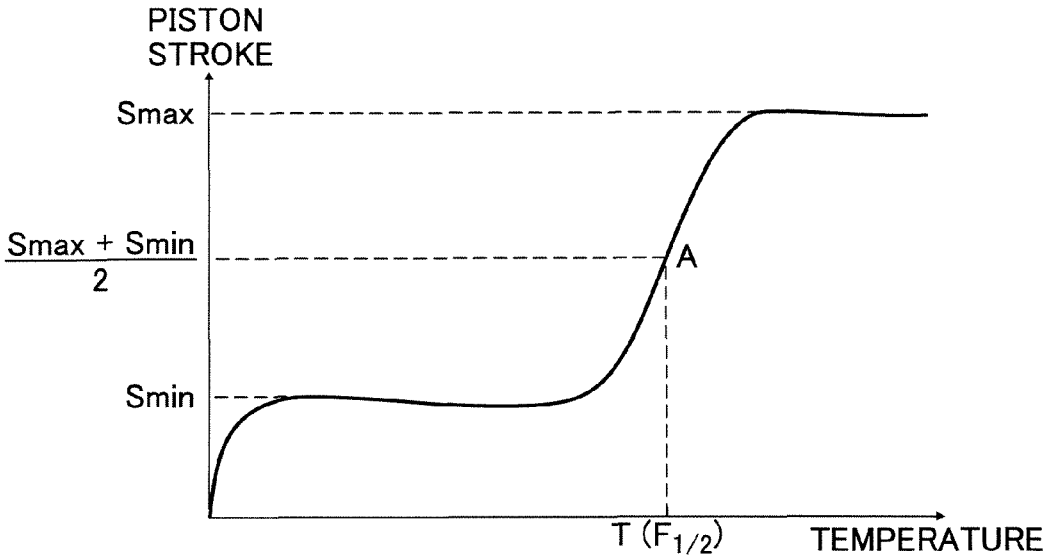
FIG. 3 is an example of a flow curve obtained by a flowtester to explain how to determine the softening temperature $T(F_{1/2})$.

As illustrated in FIG. 1, the height (W) is defined as a height of a peak specific to the fatty acid amide compound, observed at a wavenumber of 1638 $cm^{-1}$ (The baseline is drawn from 1658 to 1625 $cm^{-1}$.). When the amorphous resin is a polyester resin, as illustrated in FIG. 2, the height (R) is defined as a height of a peak specific to the polyester resin, observed at a wavenumber of 829 $cm^{-1}$ (The baseline is drawn from 784 to 899 $cm^{-1}$). The ratio (W/R) represents the ratio of the peak strength. The above peaks are absorption peaks observed in an absorption spectrum, and the heights thereof represent an absorbance.

As a polyester resin used for a binder resin of a toner for use in the present invention, a polyester resin (AX) formed from a polycondensation reaction between a polyol and a polycarboxylic acid, a modified polyester resin (AY) formed from a reaction between the polyester resin (AX) and a polyepoxide (c), etc., can be used. These resins can be used alone or in combination.

As the polyol, a diol (g) and a polyol (h) having three or more valences can be used. As the polycarboxylic acid, a dicarboxylic acid (i) and a polycarboxylic acid (j) having three or more valences can be used. These can be used alone or in combination.

As the polyester resin (AX), a linear polyester (AX1) formed from the diol (g) and the dicarboxylic acid (i); a non-linear polyester (AX2) formed from the diol (g), the dicarboxylic acid (i), and the polyol (h) having three or more valences and/or the polycarboxylic acid (j) having three or more valences; etc., can be used.

As the modified polyester resin (AY), a modified polyester resin (AY1) formed by reacting the polyepoxide (c) with the non-linear polyester (AX2), etc., can be used.

The diol (g) preferably has a hydroxyl value of from 180 to 1,900 mgKOH/g. Specific examples of the diol (g) include, but are not limited to, alkylene glycols having 2 to 36 carbon atoms (e.g., ethylene glycol, 1,2-propylene glycol, 1,3-propylene glycol, 1,4-butylene glycol, 1,6-hexanediol), alkylene ether glycols having 4 to 36 carbon atoms (e.g., diethylene glycol, triethylene glycol, dipropylene glycol, polyethylene glycol, polypropylene glycol, polybutylene glycol), alicyclic diols having 6 to 36 carbon atoms (e.g., 1,4-cyclohexanedimethanol, hydrogenated bisphenol A), 1 to 30 mol of an alkylene oxide having 2 to 4 carbon atoms (such as ethylene oxide (EO), propylene oxide (PO), and butylene oxide (BO)) adducts of the above alicyclic diols, and 2 to 30 mol of an alkylene oxide having 2 to 4 carbon atoms (such as EO, PO, and BO) adducts of bisphenols (such as bisphenol A, bisphenol F, and bisphenol S).

Among these, alkylene glycols having 2 to 12 carbon atoms, an alkylene oxide adducts of bisphenols, and mixtures thereof are preferably used. In particular, an alkylene oxide adducts of bisphenols, alkylene glycols having 2 to 4 carbon atoms, and mixtures thereof are more preferably used.

The hydroxyl value and the acid value of a resin are measured according to a method based on JIS K 0070.

The polyol (h) having three or more valences preferably has a hydroxyl value of from 150 to 1,900 mgKOH/g. Specific examples of the polyol (h) having three or more valences include, but are not limited to, aliphatic polyols having 3 to 36 carbon atoms (e.g., alkane polyols and intramolecular or intermolecular dehydration products thereof such as glycerin, triethylolethane, trimethylolpropane, pentaerythritol, sorbitol, sorbitan, polyglycerin, and dipentaerythritol; saccharides and derivatives thereof such as sucrose and methyl glucoside), 1 to 30 mol of an alkylene oxide having 2 to 4 carbon atoms (such as EO, PO, and BO) adducts of the above aliphatic polyols, 2 to 30 mol of an alkylene oxide having 2 to 4 carbon atoms (such as EO, PO, and BO) adducts of trisphenols (such as trisphenol PA), and 2 to 30 mol of an alkylene oxide having 2 to 4 carbon atoms (such as EO, PO, and BO) adducts of novolac resins (such as phenol novolac and cresol novolac, having an average polymerization degree of from 3 to 60).

Among these, 2 to 30 mol of an alkylene oxide adducts of aliphatic polyols and novolac resins are preferably used. In particular, an alkylene oxide adducts of novolac resins are more preferably used.

The dicarboxylic acid (i) preferably has an acid value of from 180 to 1,250 mgKOH/g. Specific examples of the dicarboxylic acid (i) include, but are not limited to, alkanedicarboxylic acids having 4 to 36 carbon atoms (e.g., succinic acid, adipic acid, sebacic acid) and alkenyl succinic acids (e.g., dodecenyl succinic acid), alicyclic dicarboxylic acids having 4 to 36 carbon atoms (e.g., dimer acids such as dimeric linoleic acid), alkenedicarboxylic acids having 4 to 36 carbon atoms (e.g., maleic acid, fumaric acid, citraconic acid, mesaconic acid), and aromatic dicarboxylic acids having 8 to 36 carbon atoms (e.g., phthalic acid, isophthalic acid, terephthalic acid, naphthalenedicarboxylic acid).

Among these, alkenedicarboxylic acids having 4 to 20 carbon atoms and aromatic dicarboxylic acids having 8 to 20 carbon atoms are preferably used. Acid anhydrides and lower alkyl (having 1 to 4 carbon atoms) esters (such as methyl ester, ethyl ester, and isopropyl ester) of the above compounds can also be used as the dicarboxylic acid (i).

The polycarboxylic acid (j) having three or more valences preferably has an acid value of from 150 to 1,250 mgKOH/g. Specific examples of the polycarboxylic acid (j) having three or more valences include, but are not limited to, aromatic polycarboxylic acids having 9 to 20 carbon atoms (e.g., trimellitic acid, pyromellitic acid), and vinyl polymers of unsaturated carboxylic acids (e.g., styrene/maleic acid copolymers, styrene/acrylic acid copolymers, α-olefin/maleic acid copolymers, styrene/fumaric acid copolymers; having a number average molecular weight (Mn), measured by gel permeation chromatography (GPC), of from 450 to 10,000).

Among these, aromatic polycarboxylic acids having 9 to 20 carbon atoms are preferably used, and trimellitic acid and pyromellitic acid are more preferably used. Acid anhydrides and lower alkyl (having 1 to 4 carbon atoms) esters (such as methyl ester, ethyl ester, and isopropyl ester) of the above compounds can also be used as the polycarboxylic acid (j) having three or more valences.

The diol (g), the polyol (h) having three or more valences, the dicarboxylic acid (i), and the polycarboxylic acid (j) having three or more valences can be copolymerized with an aliphatic or aromatic hydroxycarboxylic acid (k) having 4 to 20 carbon atoms or a lactone (l) having 6 to 12 carbon atoms.

Specific examples of the hydroxycarboxylic acid (k) having 4 to 20 carbon atoms include, but are not limited to, hydroxystearic acid and fatty acids of hydrogenated castor oil. Specific examples of the lactone (l) include, but are not limited to, caprolactone.

Specific examples of the polyepoxide (c) include, but are not limited to, polyglycidyl ethers (e.g., ethylene glycol diglycidyl ether, tetramethylene glycol diglycidyl ether, bisphenol A diglycidyl ether, bisphenol F diglycidyl ether, glycerin triglycidyl ether, pentaerythritol tetraglycidyl ether, glycidyl etherified phenol novolacs (having an average polymerization degree of 3 to 60)), and diene oxides (e.g., pentadiene oxide, hexadiene oxide).

Among these, polyglycidyl ethers are preferably used, and ethyleneglycol diglycidyl ether and bisphenol A diglycidyl ether are more preferably used.

The number of epoxy group included in one molecule of the polyepoxide (c) is preferably from 2 to 8, more preferably from 2 to 6, and much more preferably from 2 to 4.

The polyepoxide (c) preferably has an epoxy equivalent of from 50 to 500, more preferably from 70 to 300, and much more preferably from 80 to 200.

When the number of epoxy group and the epoxy equivalent each are within the above ranges, the resultant toner has good develop ability and fixability. It is more preferable that both of the number of epoxy group and the epoxy equivalent are simultaneously within the above ranges.

The reaction ratio of a polyol to a polycarboxylic acid, i.e., the equivalent ratio (OH)/[COOH]) of hydroxyl group ([OH]) to carboxyl group ([COOH]) is preferably from 2/1 to ½, more preferably from 1.5/1 to 1/1.3, and much more preferably from 1.3/1 to 1/1.2. The polyol and the polycarboxylic acid are selected so that the resultant polyester resin has a glass transition temperature of from 45° C. to 85° C.

The amorphous polyester resin used for a binder resin of a toner for use in the present invention can be prepared by a typical method for preparing a polyester resin. For example, a reaction preformed in an inert gas (such as nitrogen gas) atmosphere in the presence of a titanium-containing catalyst (a) can be mentioned. The reaction temperature is preferably from 150 to 280° C., more preferably from 160 to 250° C., and much more preferably from 170 to 240° C. The reaction time is preferably not less than 30 minutes, and more preferably from 2 to 4 hours, from the viewpoint of certainly performing the reaction. It is effective to reduce pressure (for example, 1 to 50 mmHg) so as to increase the reaction rate in the end-stage of the reaction.

From the viewpoint of the polymerization reactivity, the titanium-containing catalyst (a) is preferably added in an amount of from 0.0001 to 0.8% by weight, more preferably from 0.0002 to 0.6% by weight, and much more preferably from 0.0015 to 0.55% by weight, based on the resultant polymer.

Other esterification catalyst can be used in combination so long as the catalytic effect of the titanium-containing catalyst (a) does not deteriorate. Specific examples of the other esterification catalyst include, but are not limited to, tin-containing catalysts (e.g., dibutyl tin oxide), antimony trioxide, titanium-containing catalysts other than (a) (e.g., titanium alkoxide, titanyl potassium oxalate, titanium terephthalate), zirconium-containing catalysts (e.g., zirconyl acetate), germanium-containing catalysts, alkaline or alkaline earth metal catalysts (e.g., carbonates of alkaline or alkaline earth metals, lithium acetate, sodium acetate, potassium acetate, calcium acetate, sodium benzoate, potassium benzoate), and zinc acetate.

The other catalyst is preferably added in an amount of from 0 to 0.6% by weight, based on the resultant polymer. In this case, the catalyst may not color the resultant polyester resin. Therefore, the resultant polyester resin is suitable for use in a full-color toner. It is preferable that the catalyst includes the titanium-containing catalyst (a) in an amount of from 50 to 100% by weight based on total amount of the catalyst.

The linear polyester resin (AX1) can be formed by subjecting the diol (g) and the dicarboxylic acid (i) to a dehydration condensation in the presence of 0.0001 to 0.8% by weight of the titanium-containing catalyst (a), based on the resultant polymer, and the other catalyst, if desired, under normal and/or reduced pressure at a temperature of from 180 to 260° C.

The non-linear polyester resin (AX2) can be formed by subjecting the diol (g), the dicarboxylic acid (i), and the polyol (h) having three or more valences to a dehydration condensation in the presence of 0.0001 to 0.8% by weight of the titanium-containing catalyst (a), based on the resultant polymer, and the other catalyst, if desired, under normal and/or reduced pressure at a temperature of from 180 to 260° C., and subsequently reacting the polycarboxylic acid (j) having three or more valences. The polycarboxylic acid (j) having three or more valences may be simultaneously reacted with the diol (g), the dicarboxylic acid (i), and the polyol (h) having three or more valences.

The modified polyester resin (AY1) can be formed by subjecting the non-linear polyester resin (AX2) and the polyepoxide (c) to a molecular elongation reaction at a temperature of from 180 to 260° C.

The non-linear polyester resin (AX2), which reacts with the polyepoxide (c), preferably has an acid value of from 1 to 60, and more preferably from 5 to 50. When the acid value is not less than 1, the unreacted polyepoxide (c) hardly remains. Therefore, the resultant resin may not be damaged. When the acid value is not greater than 60, the resultant resin has good thermal stability.

In terms of low-temperature fixability and hot offset resistance of the resultant resin, the polyepoxide (c) is preferably added in an amount of from 0.01 to 10% by weight, and more preferably from 0.05 to 5% by weight, based the non-linear polyester resin (AX2).

The binder resin for use in the present invention may include resins other than the above-mentioned polyester resin, if desired.

Specific examples of such resins include, but are not limited to, styrene resins (e.g., styrene/alkyl (meth)acrylate copolymers, styrene/diene monomer copolymers), epoxy resins (e.g., ring-opening polymerization products of bisphenol A diglycidyl ether), and urethane resins (e.g., polyaddition products of diol and/or a polyol having three or more valences with diisocyanate).

The toner binder preferably include the other resins in an amount of from 0 to 40% by weight, more preferably from 0 to 30% by weight, and much more preferably from 0 to 20% by weight.

The crystalline polyester resin (A) for use in the present invention comprises a crystalline aliphatic polyester resin including at least 60% by mol of an ester bond represented by the following formula (1) in the main chain thereof;

$$—OCO—R—COO—(CH_2)_n— \quad (1)$$

wherein R represents a residue group of a straight-chain unsaturated aliphatic dicarboxylic acid, i.e., a straight-chain unsaturated aliphatic group having 2 to 20, preferably 2 to 4, carbon atoms; and n represents an integer of from 2 to 20, preferably 2 to 6.

Whether or not a resin includes the structure of the ester bond represented by the formula (1) can be determined by solid $C^{13}$ NMR.

The straight-chain unsaturated aliphatic group may be derived from straight-chain unsaturated dicarboxylic acids such as maleic acid, fumaric acid, 1,3-n-propenedicarboxylic acid, and 1,4-n-butenedicarboxylic acid.

In the formula (1), $(CH_2)_n$ represents a residue group of a straight-chain aliphatic diol. The residue group of a straight-chain aliphatic diol may be derived from straight-chain aliphatic diols such as ethylene glycol, 1,3-propylene glycol, 1,4-butanediol, and 1,6-hexanediol. Since the crystalline polyester resin (A) includes a straight-chain unsaturated aliphatic dicarboxylic acid as an acid unit, a crystalline structure is easily formed compared to a resin including an aromatic dicarboxylic acid as an acid unit.

The crystalline polyester resin (A) can be formed from a typical polycondensation reaction between (i) polycarboxylic acid components including a straight-chain unsaturated dicarboxylic acid or a derivative (e.g., acid anhydride, lower alkyl esters having 1 to 4 carbon atoms, acid halide) thereof and (ii) polyol components including a straight-chain aliphatic diol.

The polycarboxylic acid components may include a small amount of other polycarboxylic acids, if desired. Such polycarboxylic acids include (i) unsaturated aliphatic dicarboxylic acids having a branched-chain, (ii) saturated aliphatic polycarboxylic acids such as saturated aliphatic dicarboxylic acids and saturated aliphatic tricarboxylic acids, and (iii) aromatic polycarboxylic acids such as aromatic dicarboxylic acids and aromatic tricarboxylic acids. The polycarboxylic acid components typically include the above-mentioned polycarboxylic acids in an amount of not greater than 30% by mol, and preferably not greater than 10% by mol. These polycarboxylic acids may be used as appropriate so long as the resultant polyester resin has crystallinity.

Specific examples of such polycarboxylic acids include, but are not limited to, dicarboxylic acids (e.g., malonic acid, succinic acid, glutaric acid, adipic acid, suberic acid, sebacic acid, citraconic acid, phthalic acid, isophthalic acid, terephthalic acid), and polycarboxylic acids having three or more valences (e.g., trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, 1,2,7,8-octanetetracarboxylic acid).

The polyol components may include a small amount of other polyols, such as aliphatic branched-chained diols, cyclic diols, and polyols having three or more valences, if desired. The polyol components typically include the above-mentioned diols and/or polyols in an amount of not greater than 30% by mol, and preferably not greater than 10% by mol. These diols and/or polyols may be used as appropriate so long as the resultant polyester resin has crystallinity.

Specific examples of such polyols include, but are not limited to, 1,4-bis(hydroxymethyl)cyclohexane, polyethylene glycol, ethylene oxide adduct of bisphenol A, propylene oxide adduct of bisphenol A, and glycerin.

The crystalline polyester resin (A) preferably melts sharply to have good low-temperature fixability. Therefore, the crystalline polyester resin (A) preferably has a relatively low molecular weight. The crystalline polyester resin (A) preferably has a weight average molecular weight (Mw) of from 5,500 to 6,500, a number average molecular weight (Mn) of from 1,300 to 1,500, and the ratio (Mw/Mn) of from 2 to 5, when the molecular weight distribution of the o-dichlorobenzene-soluble components is measured by GPC.

The molecular weight distribution curve may be illustrated with a graph having a horizontal axis representing logarithm of molecular weight M (i.e., logM) and a vertical axis representing the amount (% by weight) of a sample. The molecular weight distribution curve of the crystalline polyester (A) preferably has a peak in a range of from 3.5 to 4.0 (% by weight), and the peak preferably has a half bandwidth of not greater than 1.5.

The crystalline polyester resin (A) preferably has as low a glass transition temperature (Tg) and a softening temperature ($T(F_{1/2})$) as possible unless thermostable preservability of the resultant toner deteriorates. The crystalline polyester resin (A) typically has a Tg of from 80° C. to 1300C, and preferably from 80° C. to 125° C.; and a $T(F_{1/2})$ of from 80° C. to 1300C, and preferably from 80° C. to 1250C. When the Tg and $T(F_{1/2})$ are too large, low-temperature fixability of the resultant toner deteriorates.

The softening temperature ($T(F_{1/2})$) can be determined from a flow curve obtained by a CFT-500D flowtester (from Shimadzu Corporation).

Figure 4:
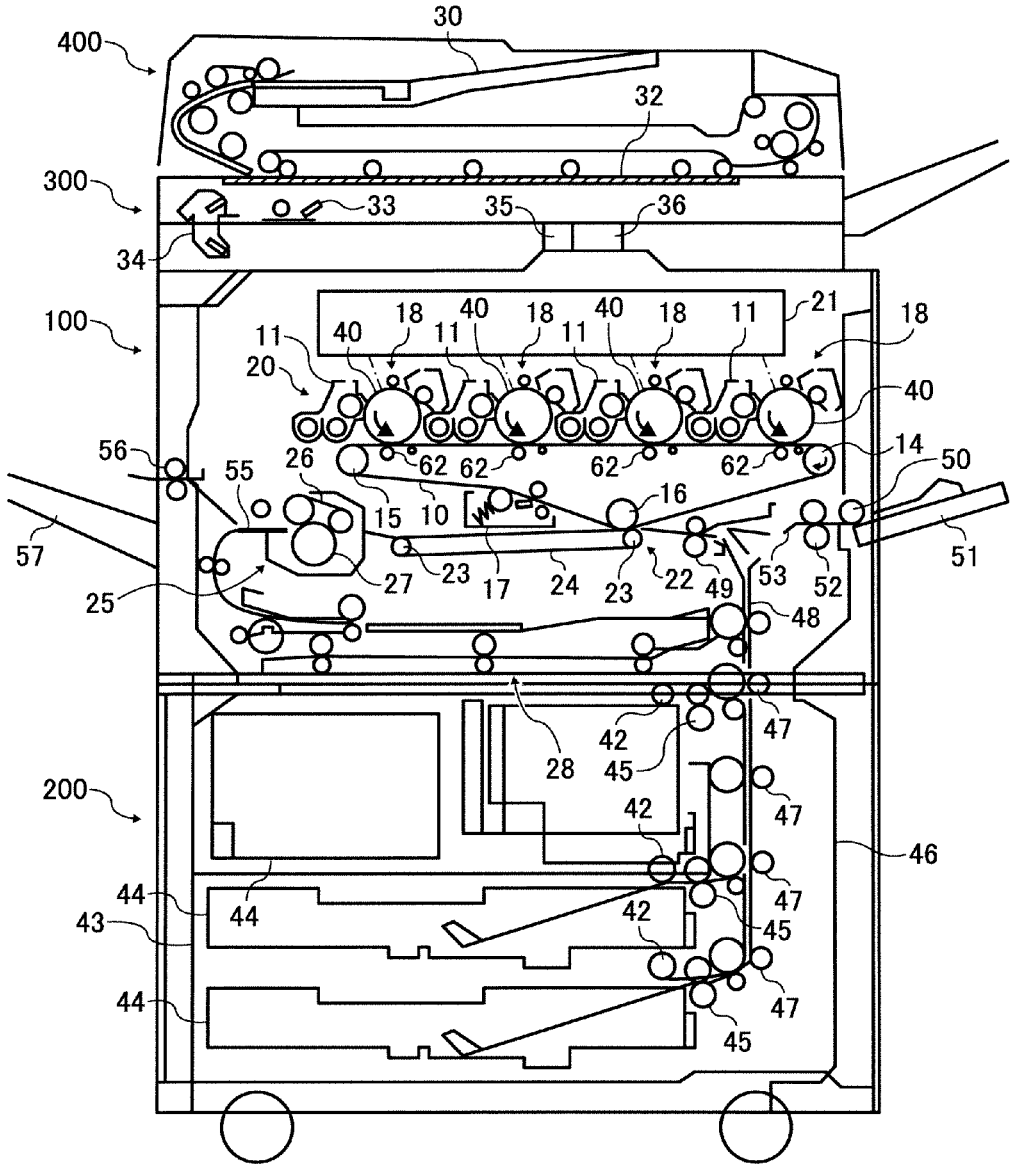
FIG. 4 is a schematic view illustrating an embodiment of the image forming apparatus of the present invention.

FIG. 4 is an example of a flow curve obtained by the CFT-500D flowtester. The X-axis represents temperature and the Y-axis represents piston stroke. As illustrated in FIG. 4, a value of a point A on the Y-axis is the midpoint between Smax and Smin. A value of the point A on the X-axis is defined as the softening temperature ($T(F_{1/2})$) in the present invention.

The measurement conditions are as follows:

Test pressure: 30 kg/cm$^2$

Temperature rising rate: 3.0° C./min

Die orifice diameter: 0.50 mm

Die length: 1.0 mm

The glass transition temperature (Tg) can be determined by a differential scanning calorimeter DSC-60 equipped with a thermal analysis workstation TA-60WS (both from Shimadzu Corporation).

The measurement conditions are as follows:

Sample container: Aluminum sample pan (with a lid)

Sample quantity: 5 mg

Reference: Aluminum sample pan (containing 10 mg of alumina)

Atmosphere: Nitrogen (flow rate: 50 ml/min)

Temperature conditions:

Start temperature: 20° C.

Temperature rising rate: 10° C./min

End temperature: 150° C.

Retention time None

Temperature falling rate: 10° C./min

End temperature: 20° C.

Retention time None

Temperature rising rate: 10° C./min

End temperature: 150° C.

Measurement results are analyzed using data analysis software TA-60 version 1.52 (from Shimadzu Corporation). At first, a DrDSC curve, which is a differential curve of a DSC curve obtained in the second temperature rising scan, is analyzed using a peak analysis function of the software, with specifying a range of −5° C. to +5° C. around the lowest temperature at which a maximum peak is observed, to determine a peak temperature. Next, the DSC curve is analyzed using the peak analysis function of the software, with specifying a range of −5° C. to +5° C. around the peak temperature, to determine a maximum endothermic temperature. The thus obtained maximum endothermic temperature is defined as the glass transition temperature (Tg) in the present invention.

When two or more polyester resins are used in combination, or a polyester resin and another kind of resin are used in combination, these resins in a form of powder can be previously mixed or melt-mixed. Of course, these can be mixed at a time of granulation. When melt-mixed, the melt-mixing temperature is preferably from 80 to 18° C., more preferably from 100 to 170° C., and much more preferably from 120 to 160° C.

When the melt-mixing temperature is too small, the resins are not satisfactorily mixed and the mixture may be uneven. When the melt-mixing temperature is too large, especially when two or more polyester resins are mixed, a transesterification reaction tends to be caused and the resultant resin cannot have good properties for used as a binder resin.

The melt-mixing time is preferably from 10 seconds to 30 minutes, more preferably from 20 seconds to 10 minutes, and much more preferably from 30 seconds to 5 minutes. When the melt-mixing time is too long, especially when two or more polyester resins are mixed, a transesterification reaction tends to be caused and the resultant resin cannot have good properties for used as a binder resin.

A mixer for use in the melt-mixing includes batch-type mixers such as a reaction vessel and continuous mixers. In order to uniformly mix in a short time at an appropriate temperature, continuous mixers are preferably used. Specific examples of the continuous mixers include, but are not limited to, an extruder, a continuous kneader, and a three-roll mill. Among these, the extruder and the continuous kneader are preferably used.

When the resin powders are previously mixed, typical mixers can be used under typical mixing conditions. In this case, the mixing temperature is preferably from 0° C. to 80° C., and more preferably from 10° C. to 60° C. The mixing time is preferably not less than 3 minutes, and more preferably from 5 to 60 minutes. Specific examples of the mixers include, but are not limited to, HENSCHEL MIXER, NAUTER MIXER, and BANBURY MIXER. Among these, HENSCHEL MIXER is preferably used.

The crystalline polyester resin (A) preferably has an acid value of not less than 20 mgKOH/g, from the viewpoint of enhancing low-temperature fixability. This is because the compatibility between paper and the resin improves. On the other hand, the crystalline polyester resin (A) preferably has an acid value of not greater than 45 mgKOH/g, from the viewpoint of enhancing hot offset resistance.

In addition, the crystalline polyester resin (A) preferably has a hydroxyl value of from 5 to 50 mgKOH/g, from the viewpoint of enhancing charge ability.

The toner for use in the present invention has excellent fixability because of including a fatty acid amide compound. It is considered that the fatty acid amide compound prevents a silicone oil, which is moved onto the surface of an image from a fixing roller, from penetrating into the image. As a result, the silicone oil remains on the surface of the image for a long period of time. Such an image having the silicone oil thereon has resistance to an external abrasion for a long period of time.

In particular, an image forming apparatus having a system speed of from 500 to 1,700 mm/sec typically uses a roll paper. When an image is formed on a sheet of the roll paper, the image tends to be abraded by the paper immediately after being fixed. Therefore, there is a demand for improving fixability immediately after an image is fixed.

The fatty acid amide compound for use in the present invention preferably has a melting point of from 90° C. to 150° C., and more preferably from 100° C. to 150° C. When the melting point is too small, the recrystallization of the crystalline polyester resin is not satisfactorily accelerated. As a result, the crystalline polyester resin and the amorphous polyester resin have good compatibility, and therefore preservability of the resultant toner deteriorates. When the melting point is too large, the fatty acid amide compound hardly melts in the toner manufacturing process and is not well dispersed in the toner. As a result, the oil is unevenly repelled, and therefore fixability of the resultant toner deteriorates.

The fatty acid amide compound can be represented by the following formula (2):

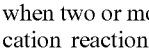

$$R_1—CO—NR_2R_3 \quad (2)$$

wherein $R_1$ represents an aliphatic hydrocarbon group having 10 to 30 carbon atoms, each of $R_2$ and $R_3$ independently represents a hydrogen atom, an alkyl group having 1 to 10 carbon atoms, an aryl group having 6 to 10 carbon atoms, or an aralkyl group having 7 to 10 carbon atoms. These alkyl group, aryl group, and aralkyl group each may be substituted with an inert substituent group such as a fluorine atom, a chlorine atom, a cyano group, an alkoxy group, and an alkylthio group. However, unsubstituted alkyl group, aryl group, and aralkyl group are preferable.

Specific examples of the fatty acid amide compound include, but are not limited to, stearic acid amide, stearic acid methylamide, stearic acid diethylamide, stearic acid benzylamide, stearic acid phenylamide, behenic acid amide, behenic acid dimethylamide, myristic acid amide, and palmitic acid amide.

Among these fatty acid amide compound, alkylenebis fatty acid amide compounds represented by the following formula (3) are preferably used:

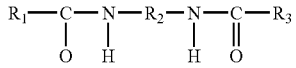

(3)

wherein each of $R_1$ and $R_3$ independently represents an alkyl or alkenyl group having 5 to 21 carbon atoms and $R_2$ represents an alkylene group having 1 to 20 carbon atoms.

Specific examples of the alkylenebis fatty acid amide compounds represented by the formula (3) include, but are not limited to, methylenebis stearic acid amide, ethylenebis stearic acid amide, methylenebis palmitic acid amide, ethylenebis palmitic acid amide, methylenebis behenic acid amide, ethylenebis behenic acid amide, hexamethylenebis stearic acid amide, hexamethylenebis palmitic acid amide, and hexamethylenebis behenic acid amide. Among these, ethylenebis stearic acid amide is preferably used.

The fatty acid amide compound typically has a softening point lower than the surface temperature of a fixing member. Thereby, the fatty acid amide compound may function as a release agent on the surface of the fixing member.

Other than the above alkylenebis fatty acid amide compounds, saturated and/or unsaturated monovalent or divalent alkylenebis fatty acid amide compounds can be used. Specific examples of such compounds include, but are not limited to, propylenebis stearic acid amide, butylenebis stearic acid amide, methylenebis oleic acid amide, ethylenebis oleic acid amide, propylenebis oleic acid amide, butylenebis oleic acid amide, methylenebis lauric acid amide, ethylenebis lauric acid amide, propylenebis lauric acid amide, butylenebis lauric acid amide, methylenebis myristic acid amide, ethylenebis myristic acid amide, propylenebis myristic acid amide, butylenebis myristic acid amide, propylenebis palmitic acid amide, butylenebis palmitic acid amide, methylenebis palmitoleic acid amide, ethylenebis palmitoleic acid amide, propylenebis palmitoleic acid amide, butylenebis palmitoleic acid amide, methylenebis arachidic acid amide, ethylenebis arachidic acid amide, propylenebis arachidic acid amide, butylenebis arachidic acid amide, methylenebis eicosenoic acid amide, ethylenebis eicosenoic acid amide, propylenebis eicosenoic acid amide, butylenebis eicosenoic acid amide, methylenebis behenic acid amide, ethylenebis behenic acid amide, propylenebis behenic acid amide, butylenebis behenic acid amide, methylenebis erucic acid amide, ethylenebis erucic acid amide, propylenebis erucic acid amide, and butylenebis erucic acid amide.

As a supply roller for supplying a silicone oil for use in the present invention, a roller including a porous cover layer including a polytetrafluoroethylene is preferably used. The supply roller is impregnated with a silicone oil having high thermal resistance. For example, polydimethylsilicone, polyphenylmethylsilicone, etc., can be used. The silicone oil preferably has a viscosity of from 1,000 to 100,000 cps at a temperature of 20° C. When the viscosity is too small, the silicone oil tends to spill.

The toner for use in the present invention may include a wax as a release agent. The wax preferably has a melting point of from 70° C. to 150° C. When the melting point is too small, thermostable preservability of the resultant toner deteriorates. When the melting point is too large, the wax cannot have releasing ability.

Specific examples of the wax include, but are not limited to, low-molecular-weight polyolefin waxes (e.g., low-molecular-weight polyethylene, low-molecular-weight polypropylene), synthesized hydrocarbon waxes (e.g., Fisher-Tropsch wax), natural waxes (e.g., beeswax, carnauba wax, candelilla wax, rice wax, montan wax), petroleum waxes (e.g., paraffin wax, microcrystalline wax), higher fatty acids (e.g., stearic acid, palmitic acid, myristic acid) and metal salts thereof, higher fatty acid amides, synthesized ester waxes, and modified waxes of the above waxes.

Among these waxes, carnauba waxes and modified waxes thereof, polyethylene waxes, and synthesized ester waxes are preferably used. In particular, pentaerythritol tetrabehenate, which is one example of the synthesized ester waxes, is preferably used. The carnauba waxes and modified waxes thereof and synthesized ester waxes can be well dispersed in a polyester or a polyol resin. Therefore, the resultant toner has good combination of offset resistance, transferability, and durability.

The above-mentioned waxes can be used alone or in combination.

The toner preferably includes the wax in an amount of from 2% to 15% by weight. When the amount is too small, the resultant toner has poor offset resistance. When the amount is too large, transferability and durability of the resultant toner deteriorate.

Any known pigments and dyes can be used as a colorant in the yellow, magenta, cyan, and black toners for use in the present invention.

Specific examples of yellow colorants include, but are not limited to, Cadmium Yellow, Pigment Yellow 155, Benzimidazolone, Mineral Fast Yellow, Nickel Titan Yellow, Naples Yellow, NAPHTHOL YELLOW S, HANSA YELLOW G, HANSA YELLOW 10G, BENZIDINE YELLOW GR, Quinoline Yellow Lake, PERMANENT YELLOW NCG, Tartrazine Lake.

Specific examples of orange colorants include, but are not limited to, molybdenium orange, PERMANENT ORANGE GTR, pyrazolone orange, vulcan orange, INDANTHRENE BRILLIANT ORANGE (RK and GK), and Benzidine Orange G.

Specific examples of red colorants include, but are not limited to, red iron oxide, Quinacridone Red, cadmium red, PERMANENT RED 4R, Lithol Red, Pyrazolone Red, Lake Red D, Brilliant Carmine 6B, Eosin Lake, Rhodamine Lake B, Alizarine Lake, and Brilliant Carmine 3B.

Specific examples of violet colorants include, but are not limited to, Fast Violet B and Methyl Violet Lake.

Specific examples of the blue colorants include, but are not limited to, cobalt blue, Alkali Blue, Victoria Blue Lake, Phthalocyanine Blue, metal-free Phthalocyanine Blue, partially-chlorinated Phthalocyanine Blue, Fast Sky Blue, and INDANTHRENE BLUE BC.

Specific examples of green colorants include, but are not limited to, Chrome Green, chromium oxide, Pigment Green B, and Malachite Green Lake.

Specific examples of black colorants include, but are not limited to, azine dyes (e.g., carbon black, oil furnace black, channel black, lampblack, acetylene black, aniline black), metal salt azo dyes, metal oxides, and combined metal oxides.

These can be used alone or in a combination.

The toner for use in the present invention may include a charge controlling agent, if desired.

Specific examples of the charge controlling agent include, but are not limited to, Nigrosine dyes; azine dyes including an alkyl group having 2 to 16 carbon atoms (disclosed in examined published Japanese Patent Application No. (hereinafter referred to as JP-B) 42-1627); lake pigments of basic dyes such as C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), and C. I. Basic Green 4 (C. I. 42000); C. I. Solvent Black 8 (C. I. 26150); quaternary ammonium salts such as benzoyl methyl hexadecyl ammonium chloride, decyl trimethyl ammonium chloride, etc.; dialkyl (such as dibutyl and dioctyl) tin compounds; dialkyl tin borate compounds; guanidine derivatives; vinyl polymers including amino group; polyamine resins such as a condensation polymer including amino group; metal complexes of monoazo dyes (disclosed in JP-Bs 41-20153, 43-27596, 44-6397, and 45-26478); metal (such as Zn, Al, Co, Cr, and Fe) complexes of salicylic acid, dialkylsalicylic acid, naphthoic acid, and dicarboxylic acid (disclosed in JP-Bs 55-42752 and 59-7385); sulfonated copper phthalocyanine pigment; organic borates; fluorine-containing quaternary ammonium salts; and calixarene compounds.

In order not to change the color tone of a full-color toner (except for a black toner), white-colored metal salts of salicylic acid derivatives are preferably used.

In order to improve transferability, durability, and filming resistance of the toner for use in the present invention, particles of inorganic materials such as silica, titanium oxide, alumina, silicon carbide, silicon nitride, and boron nitride and/or resins are externally added to the mother toner particles of the toner. (These particulate materials may be hereinafter referred to as an external additive.)

When the surface a toner particle is covered with these particles, wax particles present at the surface of the toner particle, which deteriorates transferability and durability of the toner, are covered with the particles. In addition, the contact area of the toner particle decreases.

The surfaces of inorganic material particles are preferably hydrophobized. Particles of hydrophobized metal oxides such as silica and titanium oxide are preferably used. As the resin particles, particles of polymethyl methacrylates and polystyrene, prepared by a soap-free emulsion polymerization method and having an average particle diameter of from 0.05 to 1 μm, are preferably used. It is more preferable that hydrophobized silica particles and hydrophobized titanium oxide particles are used in combination. When the amount of the hydrophobized titanium oxide particles is larger than that of the hydrophobized silica particles, the resultant toner has a good combination of stable charge ability with respect to humidity, transferability, and filming resistance.

By externally adding particles having a larger particle diameter, such as silica particles having a specific surface area of from 20 to 50 $m^2/g$ and resin particles having an average particle diameter of from 1/100 to 1/8 times the average particle diameter of toner particles, in combination with the above-mentioned inorganic material particles, durability of the resultant toner improves. When a toner is mixed with a carrier and agitated in a development device, external additives tend to be buried in toner particles. When the particles having a larger particle diameter are externally added to the toner particles, the external additives are prevented from being buried.

The inorganic material particles and/or resin particles may be internally added to toner particles. Although the effect is smaller than in the case of externally adding, transferability and durability of the resultant toner improve. In addition, pulverization property also improves. When the particles are both externally and internally added to toner particles, the resultant toner stably has good transferability and durability. This is because that the externally added particles are prevented from being buried in the toner particles.

In order to improve blocking resistance, filming resistance, and preservability of the resultant toner, silicon carbide (SiC) may be externally added to toner particles. Since fine particle of silicon carbide has a small surface energy, the surface thereof is non-adhesive and the friction force between the particles are small. Therefore, fine particles of silicon carbide can be easily mixed with toner particles having poor fluidity, so that the occurrence of blocking of toner particles and the formation of a toner film on a photoreceptor are prevented and preservability and stability of the resultant toner increase.

Fine particles of silicon carbide having a relatively large particle diameter function as abrasive powders, which prevent toner particles from adhering to the surface of a photoreceptor (i.e., the occurrence of the filming problem). In addition to preventing the occurrence of the filming problem, the fine particles of silicon carbide also prevent toner particles from sticking to a blade.

The fine particles of silicon carbide preferably have a number average particle diameter of from 0.2 to 2.0 μm, and more preferably from 0.2 to 0.8 μm. When the number average particle diameter is too small, the abrasive effect deteriorates, resulting in occurrence of the filming problem. When the number average particle diameter is too large, the abrasive effect is too large, resulting in scratching a photoreceptor, abrading a cover layer of a carrier, and deteriorating the life of a developer.

The toner preferably includes fine particles of silicon carbide in an amount of from 0.1 to 3.0 parts by weight, and more preferably from 0.2 to 1.0 parts by weight. When the amount is too small, the abrasive effect deteriorates, resulting in occurrence of the filming problem. When the amount is too large, the abrasive effect is too large, resulting in scratching a photoreceptor, abrading a cover layer of a carrier, and deteriorating the life of a developer.

When the above-mentioned fine particles of external additives are externally added to toner particles, the external additive particles and toner particles may be mixed all together. Alternatively, the external additive particles may be gradually added to and mixed with the toner particles so that these particles are evenly mixed.

The above-mentioned abrasive effect of silicon carbide much more increases when the toner is used for an image forming apparatus having a system speed of from 500 to 1700 mm/sec. The use of silicone carbide is much more effective for high-speed image forming apparatuses compared to low-speed or middle-speed image forming apparatuses. The reason is considered as follows. As the higher system speed an image forming apparatus has, the larger frictional force is generated between the abrasive powder (i.e., fine particles of silicon carbide) and a photoreceptor. As a result, a toner film formed on the photoreceptor is easily abraded and removed therefrom.

In addition, it is considered that the fine particles of silicon carbide, having a relatively large particle diameter, function as a spacer and prevent the occurrence of the filming problem.

Specific examples of hydrophobizing agents for hydrophobizing inorganic materials include, but are not limited to, dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinyltrimethoxysilane, vinyl-tris(β-methoxyethoxy)silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, didecenyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexamethyldisilazane, diethyltetramethyldisilazane, hexaphenyldisilazane, and hexatolyldisilazane.

Titanate coupling agents and aluminum coupling agents can be also used.

In order to improve cleanability of the toner, lubricants such as particles of metal salts of fatty acids and polyvinylidene fluorides may be externally added.

The toner for use in the present invention can be used as a two-component developer by mixing with powders of a carrier. As the carrier, for example, iron powders, ferrite powders, magnetite powders, nickel powders, glass bead, etc., can be used. The surfaces of these powders may be covered with a resin, etc. The carrier preferably has a volume average particle diameter of from 25 to 200 μm.

The toner and developer for use in the present invention may be contained in a container. The shape of the container is not limited to any particular shape.

The manufacturing method of the toner is not limited to any particular method. For example, the toner can be manufactured by melt-kneading pulverization methods; polymerization methods; polyaddition reaction methods using a prepolymer having isocyanate group; melt-spray methods; and methods including dissolving toner components in a solvent, removing the solvent, and pulverizing the toner components. Among these methods, melt-kneading pulverization methods; polymerization methods (e.g., suspension polymerization method, emulsion aggregation polymerization method) in which monomer components including a specific crystalline polymer and a monomer are directly polymerized in an aqueous medium; polyaddition reaction methods in which toner components including a specific crystalline polymer and a prepolymer having isocyanate group are directly elongated and/or cross-linked with an amine in an aqueous medium; and methods including dissolving toner components in a solvent, removing the solvent, and pulverizing the toner components are preferably used, but the methods are not limited thereto.

Specific examples of the melt-kneaders for use in the melt-kneading pulverization methods include, but are not limited to, batch-type two-roll mills, BANBURY MIXER, continuous twin-screw extruders (e.g., TWIN SCREW EXTRUDER KTK from Kobe Steel, Ltd., TWIN SCREW COMPOUNDER TEM from Toshiba Machine Co., Ltd., MIRACLE K.C.K from Asada Iron Works Co., Ltd., TWIN SCREW EXTRUDER PCM from Ikegai Co., KEX EXTRUDER from Kurimoto, Ltd.), and continuous single-screw kneaders (e.g., KOKNEADER from Buss Corporation).

In the polymerization methods and the polyaddition reaction methods using a prepolymer having isocyanate group, a toner component liquid is emulsified (i.e., toner component liquid droplets are formed) in an aqueous medium by application of a mechanical energy thereto. The mechanical energy is applied using means for applying strong agitation or ultrasonic vibration energy, such as HOMO MIXER, ultrasonic vibrators, and MANTON GAULIN HOMOGENIZER.

In the pulverization process, toner components are coarsely pulverized using a hammer mill, ROATPLEX, etc., and subsequently finely pulverized using a fine pulverizer using an air jet, a mechanical fine pulverizer, etc., so that the pulverized particles have an average particle diameter of from 3 to 15 μm. The pulverized particles are classified using a classifier using wind power so that the resultant particles have and a diameter of from 5 to 20 μm.

The external additive particles are externally added to toner particles by mixing the toner particles and the external additive particles using a mixer. The surfaces of the toner particles are covered with the external additive particles while aggregations of the external additive particle are pulverized. In order to improve durability of the resultant toner, it is important to uniformly and strongly adhere the external additive particles to the toner particles.

Figure 5:
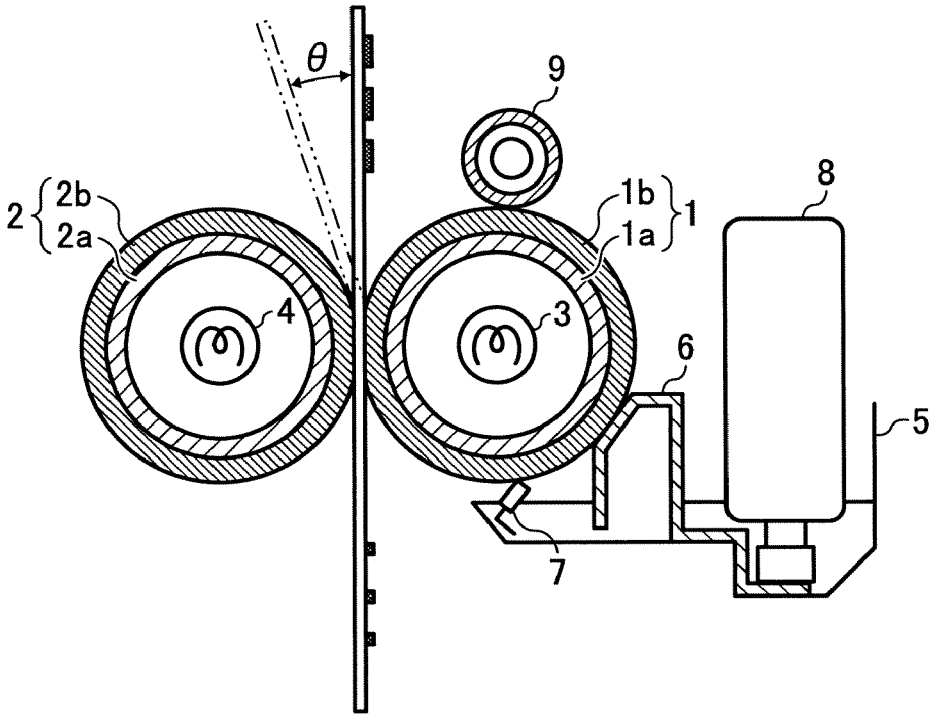
FIG. 5 is a schematic view illustrating an embodiment of a fixing device for use in the present invention.

FIG. 5 is a schematic view illustrating an embodiment of the image forming apparatus of the present invention.

The image forming apparatus illustrated in FIG. 5 includes a main body 100, a paper feeding table 200, a scanner 300 provided above the main body 100, and an automatic document feeder (ADF) 400.

The main body 100 includes a tandem image forming device 20 in which four image forming units 18 are arranged in line. The image forming units 18 each include a photoreceptor 40 serving as a latent image bearing member, and electrophotographic image forming means such as a charging means, a developing means, and a cleaning means are arranged around each of the photoreceptors 40. A light irradiator 21, configured to irradiate the photoreceptors 40 with a laser light beam corresponding to image information to form latent images thereon, is provided above the tandem image forming device 20. An intermediate transfer belt 10 made of an endless belt is provided so as to face photoreceptors 40 included in the tandem image forming device 20. Primary transfer means 62, configured to transfer toner images formed on the photoreceptors 40 onto the intermediate transfer belt 10, are arranged on the opposite side of the intermediate transfer belt 10 relative to the photoreceptors 40.

A secondary transfer device 22, configured to transfer the toner image formed on the intermediate transfer belt 10 onto a transfer paper fed from the paper feeding table 200, is provided below the intermediate transfer belt 10. The secondary transfer device 22 includes a secondary transfer belt 24 made of an endless belt tightly stretched by two rollers 23. The secondary transfer device 22 is provided so as to press a support roller 16 with the intermediate transfer belt 10 therebetween, so that the toner image formed on the intermediate transfer belt 10 is transferred onto the transfer paper. A fixing device 25 configured to fix the toner image on the transfer paper is provided beside the secondary transfer device 22. The fixing device 25 includes a fixing belt 26 made of an endless belt and a pressing roller 27. The pressing roller 27 is provided so as to press the fixing belt 26.

The secondary transfer device 22 has a function of feeding the transfer paper having the toner image thereon to the fixing device 25. Of course, the secondary transfer device 22 can include a transfer roller and/or a non-contact charger. But in this case, it is difficult for the secondary transfer device 22 to have a function of feeding the transfer paper.

The image forming apparatus illustrated in FIG. 5 includes a reverse unit 28 configured to record images on both sides of the transfer paper. The reverse unit 28 is arranged in parallel with the tandem image forming device 20 below the secondary transfer device 22 and the fixing device 25.

Each of the image forming units 18 includes a developing device 11 containing a toner.

In each of the developing devices 11, a developer bearing member bears and transports a developer to an area facing a latent image formed on each of the photoreceptors 40, and an AC bias is applied to the area, resulting in development of the latent image. By applying the AC bias to the developer, a charge quantity distribution of the toner can be narrowed, and therefore the developability of the toner increases.

The developing device 11 may be integrally supported with the photoreceptor 40 so as to form a process cartridge which can be detachably attached to an image forming apparatus. The process cartridge may further include a charging means and a cleaning means.

Next, a procedure for forming a full color image will be explained.

An original document is set to a document feeder 30 included in the automatic document feeder (ADF) 400, or placed on a contact glass 32, included in the scanner 300.

When a start switch button (not shown) is pushed, the scanner 300 immediately starts to drive, when the original image is placed on the contact glass 32, and a first runner 33 and a second runner 34 start to move. When the original document is set to the document feeder 30, the scanner 300 starts to drive after the original document is fed on the contact glass 32. The original document is irradiated with a light beam emitted by alight source via the first runner 33, and the light beam reflected from the original document is then reflected by a mirror included in the second runner 34. The light beam passes through an imaging lens 35 and is received by a reading sensor 36. Thus, image information is read.

On the other hand, when the start switch button is pushed, one of support rollers 14, 15 and 16 starts to rotate by a driving motor (not shown), and then another two support rollers start to rotate due to rotation force of the firstly-rotating support roller. Thereby, the intermediate transfer belt 10 starts to rotate. At the same time, a black toner image, a yellow toner image, a magenta toner image, and a cyan toner image each are formed on each of the photoreceptors 40 included in each of the image forming units 18. Each of the color toner images is transferred one by one onto the intermediate transfer belt 10 so that a full color image is formed thereon.

On the other hand, when the start switch button is pushed, in the paper feeding table 200, a recording paper is fed from one of multistage paper feeding cassettes 44, included in a paper bank 43, by rotating one of paper feeding rollers 42. The recording paper is separated by separation rollers 45 and fed to a paper feeding path 46. Then the recording paper is transported to a paper feeding path 48, included in the main body 100, by transport rollers 47, and is stopped by a registration roller 49.

When the recording paper is fed from a manual paper feeder 51 by rotating a paper feeding roller 50, the recording paper is separated by a separation roller 52 and fed to a manual paper feeding path 53, and is stopped by the registration roller 49.

The recording paper is timely fed to an area formed between the intermediate transfer belt 10 and the secondary transfer device 22, by rotating the registration roller 49, to meet the full color toner image formed on the intermediate transfer belt 10. The full-color toner image is transferred onto the recording paper by the secondary transfer device 22.

The recording paper having the toner image thereon is transported from the secondary transfer device 22 to the fixing device 25. The toner image is fixed on the recording paper by application of heat and pressure thereto in the fixing device 25. The recording paper is switched by a switch pick 55 and ejected by an ejection roller 56 and then stacked on an ejection tray 57. When the recording paper is switched by the switch pick 55 to be reversed in the reverse device 28, the recording paper is fed to a transfer area again so that a toner image is formed on the backside thereof. And then the recording paper is ejected by the ejection roller 56 and stacked on the ejection tray 57.

Toner particles remaining on the intermediate transfer belt 10 are removed by a cleaning device 17 in preparation for the next image forming.

FIG. 6 is a schematic view illustrating an embodiment of a fixing device for use in the present invention.

The fixing device illustrated in FIG. 6 includes a heat roller 1, a pressure roller 2, an oil application unit 5, and a cleaning roller 9.

The heat roller 1 comprises an elastic roller including a pipe-like cored bar 1*a* covered with a silicone rubber 1*b* having a thickness of 2.0 mm and a JIS hardness of 20 degrees, and a heater 3. The silicone rubber 1*b* is a molded rubber which is not abraded.

The pressure roller 2 comprises an elastic roller including a pipe-like cored bar 2*a* covered with a silicone rubber 2*b* having a thickness of 2.0 mm and a JIS hardness of 40 degrees, and a heater 4. The silicone rubber 1*b* is a molded rubber which is abraded after being molded.

The oil application unit 5 to stably apply a silicone oil to the heat roller 1 and the cleaning roller 9 to remove toner particles adhered to the surface of the heat roller 1 are provided around the heat roller 1.

The heaters 3 and 4 are connected in series and are controlled so that the surface of the heat roller 1 has a temperature of about 145° C. The oil application unit 5 includes an oil tank 8, an oil supply felt 6 to supply the silicone oil from the oil tank 8 to the heat roller 1 being in contact therewith by capillary phenomenon, and an oil blade 7 to control the amount the silicone oil applied to the heat roller 1 to a range of from 0.01 to 0.03 mg/cm$^2$. An oil film is formed on the surface of the heat roller 1 by a single rotation of the heat roller 1.

In order to efficiently separate a paper, especially a thin paper, from the heat roller 1, the pressure roller 2 preferably has a larger hardness than the heat roller 1 so that a nip formed between the heat roller 1 and the pressure roller 2 has a concave shape relative to the heat roller 1. Thereby, a separation angle θ of the paper from the heat roller 1 is increased. Further, the pressure roller 2 has a relatively small peripheral velocity so that a shearing force is applied to the paper. Thereby, the paper 1 easily separates from the heat roller 1.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Crystalline Polyester Resin

In a 5-liter four-necked flask equipped with a nitrogen inlet pipe, a dewatering pipe, a stirrer, and a thermocouple, the following components were contained.

| | |
|---|---|
| 1,4-Butanediol | 23.75 mol |
| Ethylene glycol | 1.25 mol |
| Fumaric acid | 22.75 mol |
| Trimellitic anhydride | 1.65 mol |
| Hydroquinone | 4.8 g |

The mixture was reacted for 5 hours at 160° C., and subsequently reacted for 1 hour at 200° C. Further, the mixture was reacted for 1 hour under a pressure of 8.3 kPa. Thus, a crystalline polyester resin (1) was prepared.

The crystalline polyester resin (1) had a T($F_{1/2}$) of 131° C., a Tg of 131° C., an acid value of 15 mgKOH/g, and a hydroxyl value of 53 mgKOH/g.

Preparation of Amorphous Polyester Resins (Preparation of Titanium-Containing Catalyst (a))

In a reaction vessel equipped with a condenser, a stirrer, and a nitrogen inlet pipe capable of bubbling in liquids, an 80% aqueous solution of titanium dihydroxybis(triethanolaminato) was contained. The solution was gradually heated to 90° C., while nitrogen gas was bubbled therein, and reacted (i.e., hydrolyzed) for 4 hours at 90° C. Thus, a titatnium containing catalyst (a) (i.e., titanium dihydroxybis(triethanolaminato)) was prepared.

(Preparation of Linear Polyester Resin (CAX1-1))

In a reaction vessel equipped with a condenser, a stirrer, and a nitrogen inlet pipe, 430 parts of PO 2 mol adduct of bisphenol A, 300 parts of PO 3 mol adduct of bisphenol A, 257 parts of terephthalic acid, 65 parts of isophthalic acid, 10 parts of maleic anhydride, and 2 parts of titanium tetraisopropoxide (polycondensation catalyst) were contained, and the mixture was reacted for 10 hours at 220° C. under nitrogen gas stream while removing water produced in the reaction.

The mixture was subsequently reacted under a reduced pressure of from 5 to 20 mmHg until the product had an acid value of 5. The product was cooled to room temperature and pulverized. Thus, a linear polyester resin (CAX1-1) was prepared.

The linear polyester resin (CAX1-1) had an acid value of 7, a hydroxyl value of 12, a Tg of 58° C., an Mn of 6220, and an Mp of 18900. The linear polyester resin (CAX1-1) included components having a molecular weight of 1500 or less in an amount of from 2.2% by weight and no THF-soluble component.

(Preparation of Non-Linear Polyester Resin (CAX2-1))

In a reaction vessel equipped with a condenser, a stirrer, and a nitrogen inlet pipe, 350 parts of EO 2 mol adduct of bisphenol A, 326 parts of PO 3 mol adduct of bisphenol A, 278 parts of terephthalic acid, 40 parts of phthalic anhydride, and 2 parts of titanium tetraisopropoxide (polycondensation catalyst) were contained, and the mixture was reacted for 16 hours at 230° C. under nitrogen gas stream while removing water produced in the reaction. The mixture was subsequently reacted for 8 hours under a reduced pressure of from 5 to 20 mmHg until the product had an acid value of 2. Subsequently, 62 parts of trimellitic an hydride was added thereto. The mixture was reacted for 2 hours under normal pressure while being hermetically sealed. The product was cooled to room temperature and pulverized. Thus, a non-linear polyester resin (CAX2-1) was prepared.

The non-linear polyester resin (CAX2-1) had an acid value of 7, a hydroxyl value of 12, a Tg of 58° C., an Mn of 6220, and an Mp of 18900. The non-linear polyester resin (CAX2-1) included components having a molecular weight of 1500 or less in an amount of from 2.2% by weight and no THF-soluble component.

(Preparation of Amorphous Polyester Resin (B))

At first, 400 parts of the linear polyester resin (CAX1-1) and 600 parts of the non-linear polyester resin (CAX2-1) were melt-mixed using a continuous kneader under conditions in which a jacket temperature was 150° C. and a retention time was 3 minutes. The melted resin was cooled to 30° C. over a period of 4 minutes using a steel belt cooler and pulverized. Thus, an amorphous polyester resin (B) was prepared.

Example 1

Preparation of Toner

The following components were mixed using a blender.

| | |
|---|---|
| Crystalline Polyester Resin (1) | 35 parts |
| Amorphous Polyester Resin (B) | 65 parts |
| Polypropylene wax (having a melting point of 153° C.) | 5 parts |
| Charge controlling agent (a metal salt of a salicylic acid derivative) | 2 parts |
| Colorant (a copper phthalocyanine blue pigment) | 6 parts |
| Stearic acid amide compound (having a melting point of 151° C.) | 5 parts |

The mixture was melt-kneaded using a twin-screw extruder under the following conditions:

Kneading temperature: 140° C.

Extrusion rate: 10 kg/hour

Rolling gap: 2 mm

Leaving time before pulverization: 48 hours

The kneaded mixture was pulverized and classified. Thus, mother toner particles having a volume average particle diameter of 7.6 μm were prepared.

Next, 100 parts of the mother toner particles were mixed with 0.4 parts of hydrophobized silica particles (surface-treated with hexamethyldisilazane, having an average primary particle diameter of 0.02 μm) using HENSCHEL MIXER. Thus, a cyan toner (1) was prepared.

The mixing conditions were as follows:

Revolution: 1500 rpm

Mixing operation: A cycle of mixing for 60 seconds followed by pause for 60 seconds was repeated for 8 times.

(Measurements)

(1) Measurement of Ratio (W/R) of Fatty Acid Amide Compound

The ratio (W/R) was determined from an absorption spectrum obtained by an ATR method (total reflectance method) using a Fourier transform infrared (FT-IR) spectrophotometer. Since a measurement sample subjected to the ATR method needs to have a smooth surface, a toner was pelletized to have a smooth surface. In particular, 0.6 g of a toner was pelletized into a pellet having a diameter of 20 mm by imposing a load of 1 t for 30 seconds using a pelletizer.

As illustrated in FIG. 1, the height (W) is defined as a height of a peak specific to the fatty acid amide compound, observed at a wavenumber of 1638 $cm^{-1}$ (The baseline is drawn from 1658 to 1625 $cm^{-1}$.). As illustrated in FIG. 2, the height (R) is defined as a height of a peak specific to the amorphous polyester resin, observe data wave number of 829 $cm^{-1}$ (The baseline is drawn from 784 to 899 $cm^{-1}$). The ratio (W/R) represents the ratio of the peak strength. The above peaks are absorption peaks observed in an absorption spectrum, and the heights thereof represent an absorbance.

(2) Measurement of Acid Value and Hydroxyl Value of Resin

The acid value and hydroxyl value of a resin are measured based on a method according to JIS K 0070. When the resin is not dissolved in the solvent, dioxane, THF, o-dichlorobenzene, etc., were used.

(3) Measurement of Melting Point of Wax

An instrument TG-DSC TAS-100 (from Rigaku Corporation) was used. At first, about 10 mg of a sample was contained in an aluminum container, and the aluminum container was put on a holder unit and set in an electric furnace. The sample was heated from 25° C. to 180° C. at a temperature rising rate of 10° C./min. The melting point was determined from the contact point of the tangent line of the endothermic curve near the melting point and the baseline, using an analysis system of the TAS-100.

(4) Measurement of System Speed

The system speed was calculate from the following equation:

$$B(\text{mm/sec})=100\ (\text{sheets})\times 297\ (\text{mm})/A(\text{sec})$$

wherein A (sec) represents a printing time while 100 sheets of an A4-sized paper (having a length of 297 mm in the printing direction) are continuously longitudinally discharged, and B represents a system speed (mm/sec).

(Evaluations)

(1) Filming Resistance (Preparation of Carrier)

The following components were dispersed for 10 minutes using HOMOMIXER to prepare a coating liquid for forming a silicone resin cover layer.

| | |
|---|---|
| Silicone resin solution (solid content: 23% by weight, SR2410 from Dow Corning Toray Co., Ltd.) | 132.2 parts |
| Aminosilane (solid content: 100% by weight, SH6020 from Dow Corning Toray Co., Ltd.) | 0.66 parts |
| Conductive particles (base substance: alumina, lower layer: tin dioxide, upper layer: indium oxide including tin oxide, average particle diameter: 0.35 μm, specific resistance: 3.5 Ω·cm) | 31 parts |
| Toluene | 300 parts |

The above coating liquid was coated on the surface of a calcined ferrite powder (i.e., a core material) having a volume average particle diameter of 70 μm using SPIRA COTA® (from Okada Seiko Co., Ltd.) at an inner temperature of 40° C., so that a silicone resin layer having a thickness of 0.15 μm was formed thereon. Subsequently, the power was dried, and then calcined in an electric furnace for 1 hour at 300° C. The bulk of the powder was cooled, and then sieved with a sieve having an opening of 125 μm. Thus, a carrier (1) was prepared.

(Image Evaluation)

At first, 4% by weight of the toner (1) and 96% by weight of the carrier (1) were mixed to prepare a two-component developer. The two-component developer was set in a modified copier IMAGIO NEO C600 (manufactured and modified by Ricoh Co., Ltd.), which is modified to have a linear speed was 1650 mm/sec, a development gap of 1.26 mm, a doctor blade cap of 1.6 mm, and so that the reflective photosensor was turned off, and the image bearing member, development device, and transfer device are controlled (i.e., heated or cooled) to have a substantial temperature of from 30 to 48° C. The transfer current was 30 μA.

A running test in which 50,000 printings are produced per day was performed. Before starting the running test and after the 100,000$^{th}$ printing was produced, 3 sheets of a black solid image were produced on an A3-sized paper and visually observed whether the images have image defects (white spots). When a film of the toner was formed on the photoreceptor, image defects (white spots) are observed.

The filming resistance of a toner was evaluated by the observed amount of image defects (white spots) and graded as follows.

Very good: Image defects are slightly observed.

Good: A small amount of image defects are observed.

Average: An average amount of image defects are observed.

Poor: A large amount of image defects are observed.

In addition, the surface of the photoreceptor was observed with a microscope at a magnification of 10 times whether scratches were made or not.

Very Good: Less than 15 scratches are observed in 5 views.

Good: 15 to 50 scratches are observed in 5 views.

Average: 51 to 80 scratches are observed in 5 views.

Poor: More than 81 scratches are observed in 5 views.

(2) Low-temperature Fixability

The above-prepared two-component developer was set in a modified copier IMAGIO NEO C600 (manufactured and modified by Ricoh Co., Ltd.) including an oil applicator, which is modified to have a linear speed of 1650 mm/sec. In this evaluation, an oil was applied to the fixing roller. As the transfer paper, a PPC paper TYPE 6200 (from Ricoh Co., Ltd.) was used.

An image was produced on the paper so that the image has an image density of 1.2 when measured by a Macbeth densitometer. Images were produced at various fixing temperatures by varying the temperature of the fixing roller in 5° C. intervals.

The produced images were left for 3 days, and subjected to the evaluation of fixing ratio. The fixing ratio of the image was calculated by the following equation:

$$R=(Da/Db)\times 100$$

wherein R (%) represents a fixing ratio, Db represents the initial image density of an image, and Da represents the image density of the image rubbed by a clock meter equipped with a sand eraser for 10 times.

A temperature at which the fixing ratio R (%) exceeds 70% was defined as a minimum fixable temperature. The low-temperature fixability was evaluated as follows:

Very good: The minimum fixable temperature is extremely small.

Good: The minimum fixable temperature is very small.

Average: The minimum fixable temperature is smaller than that of conventional toners.

Poor: The minimum fixable temperature is larger than that of conventional toners.

(3) High-Temperature Preservability

In a 30 ml screw vial, 11 g of a toner was contained and a cap was put thereon. The capped vial was tapped for 100 times using a tapping device, and then left for 24 hours at 50° C. The toner was subjected to a penetration test using a penetration testing machine.

The high-temperature preservability was evaluated using the penetration length as follows.

Very good: The penetration length is greater than 25 mm.

Good: The penetration length is from 15 to 25 mm.

Average: The penetration length is from 5 to 15 mm.

Poor: The penetration length is less than 5 mm.

Example 2

The procedure for preparing the toner (1) in Example 1 was repeated except that the amount of the stearic acid amide compound having a melting point of 151° C. was changed from 5 parts to 1 part.

Comparative Example 1

The procedure for preparing the toner (1) in Example 1 was repeated except that the amount of the stearic acid amide compound having a melting point of 151° C. was changed from 5 parts to 6 parts.

Comparative Example 2

The procedure for preparing the toner (1) in Example 1 was repeated except that the amount of the stearic acid amide compound having a melting point of 151° C. was changed from 5 parts to 0.5 parts.

Example 3

The procedure for preparing the toner (1) in Example 1 was repeated except that the stearic acid amide compound having a melting point of 151° C. was replaced with a stearic acid amide compound having a melting point of 148° C.

Example 4

The procedure for preparing the toner (1) in Example 1 was repeated except that the stearic acid amide compound having a melting point of 151° C. was replaced with a stearic acid amide compound having a melting point of 92° C.

Example 5

The procedure for preparing the toner (1) in Example 1 was repeated except that the stearic acid amide compound having a melting point of 151° C. was replaced with a stearic acid amide compound having a melting point of 88° C.

Example 6

The procedure for preparing the toner (1) in Example 1 was repeated except that the amount of the crystalline polyester resin (1) was changed from 35 parts to 5 parts and the amount of the amorphous polyester resin (B) was changed from 65 parts to 95 parts.

Example 7

The procedure for preparing the toner (1) in Example 1 was repeated except that the polypropylene wax having a melting point of 153° C. was replaced with a polypropylene wax having a melting point of 145° C.

Example 8

The procedure for preparing the toner (1) in Example 1 was repeated except that the polypropylene wax having a melting point of 153° C. was replaced with a carnauba wax having a melting point of 180° C.

Example 9

The procedure for preparing the toner (1) in Example 1 was repeated except that 0.3 parts of silicon carbide particles having a primary particle diameter of 0.2 μm was mixed together with the hydrophobized silica particles.

Example 10

The procedure for preparing the toner (1) in Example 1 was repeated except that 0.3 parts of silicon carbide particles having a primary particle diameter of 2.0 μm was mixed together with the hydrophobized silica particles.

Example 11

The procedure for preparing the toner (1) in Example 1 was repeated except that 3.0 parts of silicon carbide particles having a primary particle diameter of 2.0 μm was mixed together with the hydrophobized silica particles.

Comparative Example 3

The procedure for preparing the toner (1) in Example 1 was repeated except that 3.5 parts of silicon carbide particles having a primary particle diameter of 0.2 μm was mixed together with the hydrophobized silica particles.

Comparative Example 4

The procedure for preparing the toner (1) in Example 1 was repeated except that 3.5 parts of silicon carbide particles having a primary particle diameter of 2.0 μm was mixed together with the hydrophobized silica particles.

Comparative Example 5

The procedure for preparing the toner (1) in Example 1 was repeated except that 3.0 parts of silicon carbide particles having a primary particle diameter of 2.2 μm was mixed together with the hydrophobized silica particles.

The evaluation results are shown in Table 1.

TABLE 1

| | W/R | Filming Resistance | Low-temperature Fixability | High-temperature Preservability | Scratches made on Photoreceptor |
|---|---|---|---|---|---|
| Ex. 1 | 0.040 | Average | Good | Very Good | Very Good |
| Ex. 2 | 0.010 | Very Good | Average | Average | Very Good |
| Comp. Ex. 1 | 0.042 | Poor | Very Good | Very Good | Very Good |
| Comp. Ex. 2 | 0.009 | Very Good | Poor | Poor | Very Good |
| Ex. 3 | 0.040 | Good | Very Good | Very Good | Very Good |
| Ex. 4 | 0.039 | Average | Very Good | Very Good | Very Good |
| Ex. 5 | 0.039 | Average | Very Good | Good | Very Good |
| Ex. 6 | 0.039 | Average | Good | Very Good | Very Good |
| Ex. 7 | 0.039 | Average | Very Good | Very Good | Very Good |
| Ex. 8 | 0.039 | Average | Very Good | Good | Very Good |
| Ex. 9 | 0.040 | Good | Good | Very Good | Good |
| Ex. 10 | 0.040 | Very Good | Good | Very Good | Good |
| Ex. 11 | 0.40 | Very Good | Good | Very Good | Good |
| Comp. Ex. 3 | 0.039 | Very Good | Good | Very Good | Poor |
| Comp. Ex. 4 | 0.039 | Very Good | Good | Very Good | Poor |
| Comp. Ex. 5 | 0.039 | Very Good | Good | Very Good | Poor |

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an image bearing member configured to bear a latent image;

a charging device configured to charge a surface of the image bearing member;

an irradiating device configured to write an electrostatic latent image on the charged surface of the image bearing member;

a developing device configured to develop the electrostatic latent image formed on the surface of the image bearing member with a developer comprising a toner;

a transfer device configured to transfer the toner image onto at least one of a transfer member and a recording medium;

a cleaning device configured to remove residual toner particles remaining on the surface of the image bearing member; and a fixing device configured to fix the toner image on the recording medium, comprising:

a heat roller; and an oil applicator configured to apply a silicone oil to the heat roller, wherein the image forming apparatus has a system speed of from 500 to 1700 mm/sec, and wherein said developing device comprises a developer comprising a toner comprising mother toner particles comprising:

a binder resin comprising a crystalline polyester resin and an amorphous polyester resin;

a fatty acid amide compound; and a colorant, wherein a ratio (W/R) of a height (W) of a peak at a wavenumber of 1638 $cm^{-1}$, specific to the fatty acid amide compound, to a height (R) of a peak at a wavenumber of 829 $cm^{-1}$, specific to the amorphous polyester resin, is from 0.010 to 0.040 in an absorption spectrum obtained by an ATR method (total reflectance method) using a Fourier transform infrared (FT-IR) spectrophotometer.

2. The image forming apparatus according to claim 1, wherein the fatty acid amide compound has a melting point of from 90° C. to 150° C.

3. The image forming apparatus according to claim 1, wherein the toner further comprises a wax having a melting point of from 70° C. to 150° C.

4. The image forming apparatus according to claim 3, wherein the wax is at least one member selected from the group consisting of a carnauba wax, a polyethylene wax, and a synthesized ester wax.

5. The image forming apparatus according to claim 1, wherein the toner further comprises silicone carbide particles in an amount of from 0.1 to 3.0 parts by weight based on 100 parts by weight of the mother toner particles.

6. The image forming apparatus according to claim 5, wherein the silicone carbide particles have a primary number average particle diameter of from 0.2 to 2 μm.

7. A toner, comprising mother toner particles comprising:

a binder resin comprising a crystalline polyester resin and an amorphous polyester resin;

a fatty acid amide compound; and a colorant, wherein a ratio (W/R) of a height (W) of a peak at a wavenumber of 1638 $cm^{-1}$, specific to the fatty acid amide compound, to a height (R) of a peak at a wavenumber of 829 $cm^{-1}$, specific to the amorphous polyester resin, is from 0.010 to 0.040 in an absorption spectrum obtained by an ATR method (total reflectance method) using a Fourier transform infrared (FT-IR) spectrophotometer.

8. The toner according to claim 7, wherein the fatty acid amide compound has a melting point of from 90° C. to 150° C.

9. The toner according to claim 7, further comprising a wax having a melting point of from 70° C. to 150° C.

10. The toner according to claim 9, wherein the wax is at least one member selected from the group consisting of a carnauba wax, a polyethylene wax, and a synthesized ester wax.

11. The toner according to claim 7, further comprising silicone carbide particles in an amount of from 0.1 to 3.0 parts by weight based on 100 parts by weight of the mother toner particles.

12. The toner according to claim 11, wherein the silicone carbide particles have a primary number average particle diameter of from 0.2 to 2 μm.

13. A process cartridge detachably attachable to an image forming apparatus, comprising:

an image bearing member configured to bear a latent image; and a developing device configured to develop the latent image comprising the toner according to claim 7.

14. The process cartridge according to claim 13, wherein the fatty acid amide compound has a melting point of from 90° C. to 150° C.

15. The process cartridge according to claim 13, wherein the toner further comprises a wax having a melting point of from 70° C. to 150° C.

16. The process cartridge according to claim 15, wherein the wax is at least one member selected from the group consisting of a carnauba wax, a polyethylene wax, and a synthesized ester wax.

17. The process cartridge according to claim 13, wherein the toner further comprises silicone carbide particles in an amount of from 0.1 to 3.0 parts by weight based on 100 parts by weight of the mother toner particles.

18. The process cartridge according to claim 17, wherein the silicone carbide particles have a primary number average particle diameter of from 0.2 to 2 μm.

* * * * *